US007703938B1

(12) United States Patent
Brown, Jr.

(10) Patent No.: US 7,703,938 B1
(45) Date of Patent: Apr. 27, 2010

(54) FLASHLIGHT MOUNTING CLIP

(76) Inventor: Kenneth J. Brown, Jr., 173 Woodland Dr., Downingtown, PA (US) 19335

( * ) Notice: Subject to any disclaimer, the term of this patent is extended or adjusted under 35 U.S.C. 154(b) by 0 days.

(21) Appl. No.: 11/754,443

(22) Filed: May 29, 2007

Related U.S. Application Data

(63) Continuation-in-part of application No. 11/311,296, filed on Dec. 19, 2005, now abandoned.

(51) Int. Cl.
*F21V 33/00* (2006.01)

(52) U.S. Cl. ..... 362/106; 362/105; 362/191; 362/396

(58) Field of Classification Search ..... 362/190, 362/191, 105, 106, 396; 2/422
See application file for complete search history.

(56) References Cited

U.S. PATENT DOCUMENTS

| | | | | | |
|---|---|---|---|---|---|
| 2,402,877 | A * | 6/1946 | Dial | 248/205.5 |
| 4,390,927 | A * | 6/1983 | Von Feldt | 362/476 |
| 4,406,040 | A | 9/1983 | Cannone | 24/3 J |
| 5,103,384 | A * | 4/1992 | Drohan | 362/191 |
| 5,199,780 | A | 4/1993 | Ekman | 362/106 |
| 5,683,171 | A * | 11/1997 | Van Gennep | 362/191 |
| 5,690,416 | A * | 11/1997 | Van Gennep | 362/191 |
| 6,206,543 | B1 * | 3/2001 | Henry | 362/191 |
| D464,750 | S | 10/2002 | Cooper | D26/28 |
| 7,040,783 | B1 * | 5/2006 | Christianson | 362/396 |
| 7,055,979 | B2 * | 6/2006 | Lee | 362/105 |
| 7,168,821 | B2 * | 1/2007 | Huang | 362/103 |
| 2005/0254238 | A1 * | 11/2005 | Parker et al. | 362/191 |

* cited by examiner

*Primary Examiner*—Thomas M Sember
(74) *Attorney, Agent, or Firm*—Allen, Dyer, Doppelt, Milbrath & Gilchrist, P.A.

(57) ABSTRACT

A mounting clip is formed for attachment to the side of a bill of a cap to mount a flashlight for hands free operation. The mounting clip is constructed with a clip portion and an integral flashlight mounting portion, both of which are made of memory retentive plastic so that the mounting of either portion takes advantage of the spring bias to exert a firm grip on the surface the portion engages. The upper and lower portions of the flashlight mounting portion are formed in a pair of arcuate segments that when taken together form a generally circular barrel grasping portion in two different diameters corresponding to known configurations of mini-flashlights. The surface of the mounting clip can be coated with a rubber-like material that enhances the grip on the surface engaged thereby. The clip portion can be formed with a different width dimension than the flashlight mounting portion.

15 Claims, 3 Drawing Sheets

Fig. 1
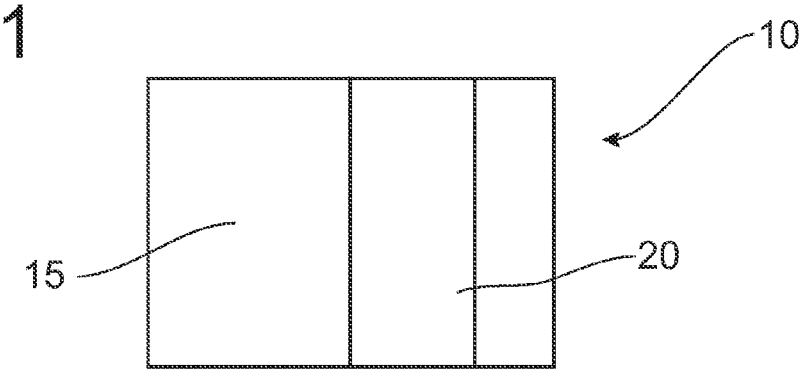
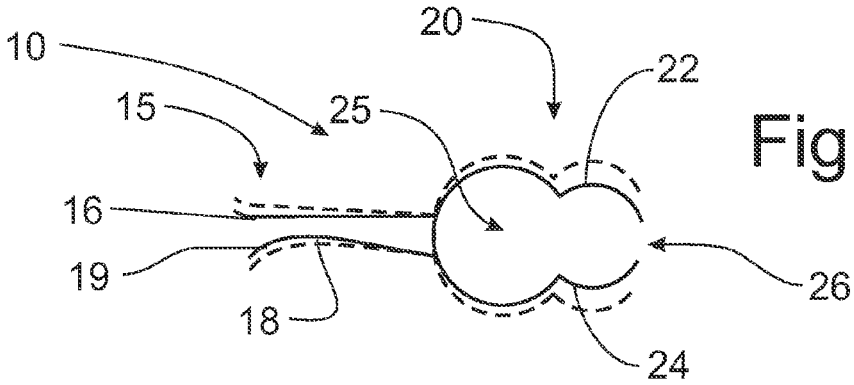
Fig. 2
Fig. 3
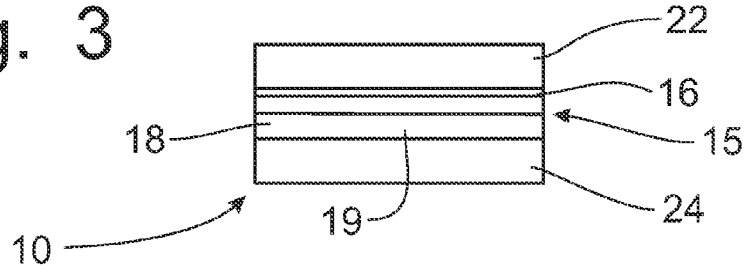
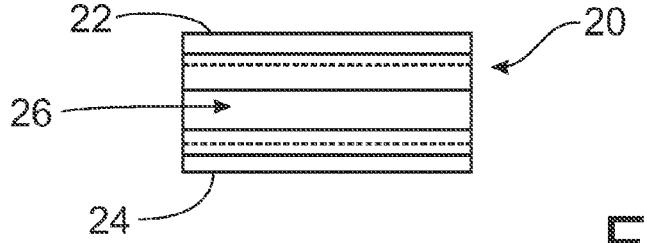
Fig. 4

Fig. 5
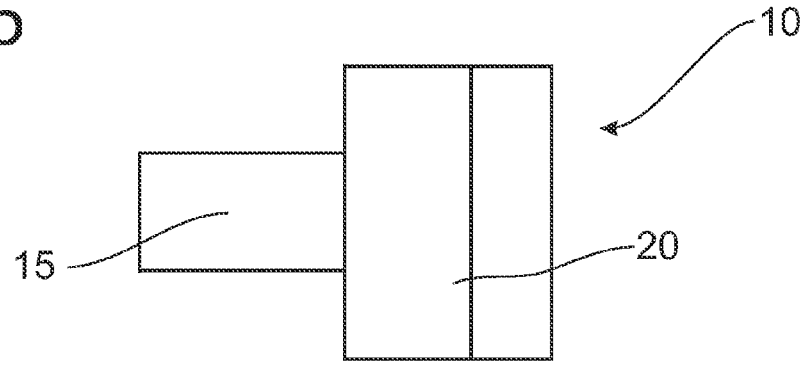
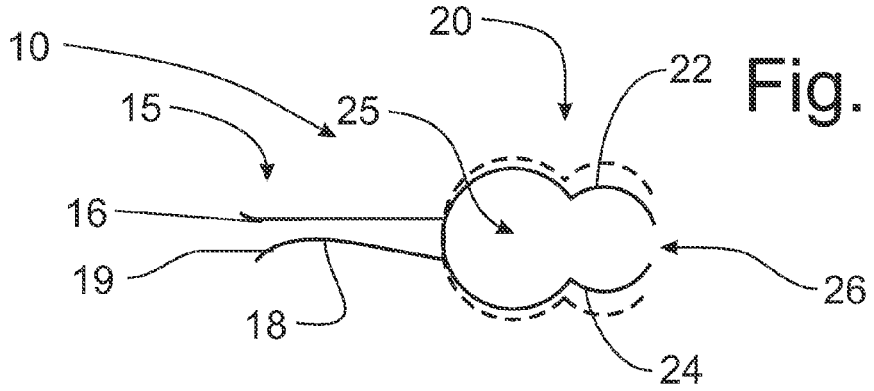
Fig. 6
Fig. 7
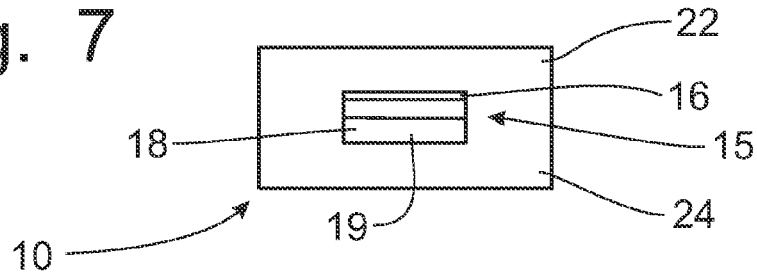
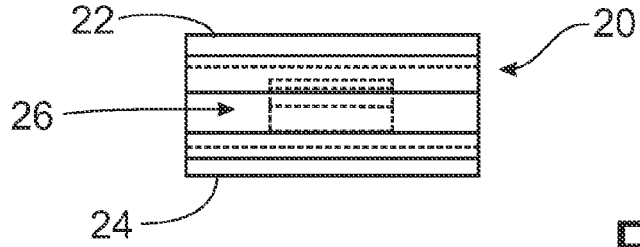
Fig. 8

FLASHLIGHT MOUNTING CLIP

CROSS-REFERENCE TO RELATED APPLICATIONS

This application is a continuation-in-part of U.S. patent application Ser. No. 11/311,296, filed on Dec. 19, 2005, entitled "Flashlight Hat clip", now abandoned, the entire contents of which are incorporated herein by reference.

FIELD OF THE INVENTION

This invention relates to an accessory for use in mounting lighting devices to headwear and, more particularly, to a mounting clip that can be detachably mounted on the bill of a cap to mount temporarily a flashlight thereto.

BACKGROUND OF THE INVENTION

Flashlights have long been popular as portable light sources and can provide a lightweight, compact package for casting a beam of light. More modern flashlight configurations utilize a light emitting diode that provides a strong light beam from relatively small batteries carried in the flashlight casing. Generally, these mini-flashlights are not self-supporting. Thus, it is typically necessary for a user of these mini-flashlights to use one hand to hold and position the light beam emanating from the flashlight, which can be a hindrance if the user is trying to accomplish a task that requires the use of more than one hand.

The placement of a flashlight into a mounting apparatus for support on headwear is shown in U.S. Pat. No. 5,199,780, granted on Apr. 6, 1993, to John Ekman, wherein the flashlight hat clip is arranged to be mounted on the headband of the hat to support a flashlight to be carried by the hat while being worn. In U.S. Pat. No. 4,406,040, issued on Sep. 27, 1983, to Robert Cannone, a lighting apparatus is affixed to a mounting clip that can be affixed to the front bill of a cap and be positionally adjustable to be pointed downwardly in front of the user of the apparatus. A spring clip having a lighting device integrally formed therewith for mounting on the front of the bill of a cap is disclosed in U.S. Design Pat. No. D464,750, issued to Ira Cooper on Oct. 22, 2002.

None of the above-identified prior art documents teach a device that is adapted for use with multiple mini-flashlight sizes and are positionable on the side of the bill of a cap so that the weight of the device is not pulling down on the cap and making the cap difficult to remain in place. Accordingly, it would be desirable to provide a mounting clip that is independent of the flashlight and that can be mounted to the bill of a cap along the side of the head to direct a beam of light forwardly of the user to free the use of both hands of the user for other activities. It would further be desirable to provide a mounting clip that can be used with multiple sizes of mini-flashlights.

SUMMARY OF THE INVENTION

It is an object of this invention to overcome the disadvantages of the prior art by providing a mounting clip that can be utilized to mount a mini-flashlight to the side of the bill of a cap.

It is another object of this invention to provide a mounting clip that can be utilized with substantially any mini-flashlight.

It is a feature of this invention that the flashlight mounting portion is formed with arcuate segments that when taken together form a generally circular barrel grasping portion for engaging the barrel of a flashlight placed therein.

It is another feature of this invention that the flashlight mounting portion is formed with two barrel grasping portions having different diameters corresponding to two known sizes of mini-flashlights.

It is an advantage of this invention that the mounting clip will be operable with most current commercially available mini-flashlights.

It is still another feature of this invention that both the clip portion and the flashlight mounting portion are formed with spring-biased members that operate to firmly grasp the bill of the cap and the barrel of the flashlight, respectively.

It is another advantage of this invention that the mini-flashlight will be stably supported on the bill of a cap for hands free operation.

It is still another advantage of this invention that the flashlight mounted on the side of the bill by the mounting clip is directed in the orientation of the wearer's eyes.

It is yet another feature of this invention that the clip portion can be formed with a different width dimension than the integrally formed flashlight mounting portion.

It is still another object of this invention to provide a mounting clip for attaching a flashlight to the side of a bill of a cap, which is durable in construction, inexpensive of manufacture, carefree of maintenance, facile in assemblage, and simple and effective in use.

These and other objects, features and advantages are accomplished according to the instant invention by providing a mounting clip formed for attachment to the side of a bill of a cap to mount a flashlight for hands free operation. The mounting clip is constructed with a clip portion and an integral flashlight mounting portion, both of which are made of memory retentive plastic so that the mounting of either portion takes advantage of the spring bias to exert a firm grip on the surface the portion engages. The upper and lower portions of the flashlight mounting portion are formed in a pair of arcuate segments that when taken together form a generally circular barrel grasping portion in two different diameters corresponding to known configurations of mini-flashlights. The surface of the mounting clip can be coated with a rubber-like material that enhances the grip on the surface engaged thereby. The clip portion can be formed with a different width dimension than the flashlight mounting portion.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is top plan view of a first embodiment of the mounting clip incorporating the principles of the instant invention;

FIG. 2 is a side elevational view of the mounting clip shown in FIG. 1, the movement of the components of the mounting clip being shown in dashed lines;

FIG. 3 is a clip-end elevational view corresponding to lines 3-3 of FIG. 2;

FIG. 4 is a flashlight mounting end elevational view corresponding to lines 4-4 of FIG. 2;

FIG. 5 is top plan view of a second embodiment of the mounting clip incorporating the principles of the instant invention;

FIG. 6 is a side elevational view of the mounting clip shown in FIG. 5, the movement of the flashlight mounting components of the mounting clip being shown in dashed lines;

FIG. 7 is a clip-end elevational view corresponding to lines 7-7 of FIG. 6;

FIG. 8 is a flashlight mounting end elevational view corresponding to lines 8-8 of FIG. 6;

DETAILED DESCRIPTION OF THE PREFERRED EMBODIMENT

Referring to FIGS. 1-4, a first embodiment of the flashlight mounting clip incorporating the principles of the instant invention can best be seen. The mounting clip 10 is preferably formed of plastic, although other materials, such as nylon, steel and other durable materials could be used as well. Furthermore, the configuration of the mounting clip 10 is particularly adapted to being formed by injection molding. The mounting clip 10 is formed of two main, integrally formed components, the clip portion 15 and the flashlight mounting portion 20.

Figure 9:
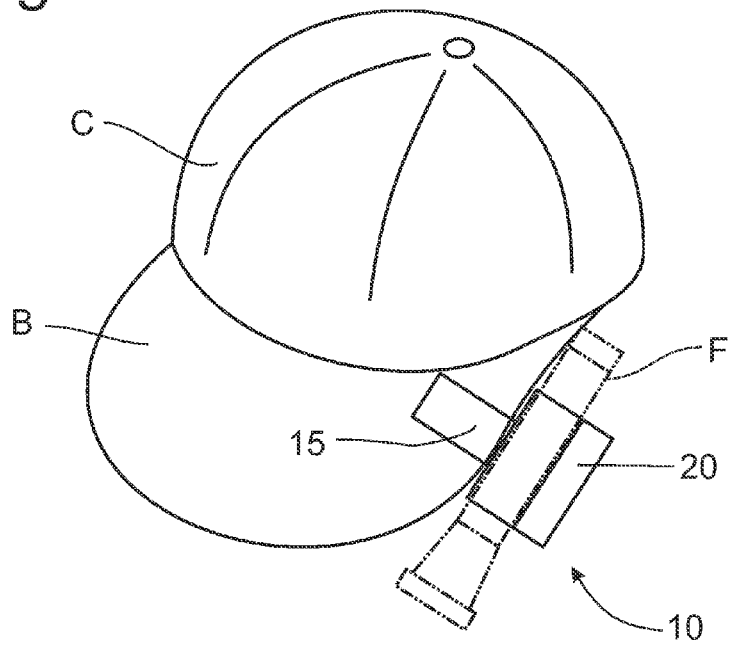
FIG. 9 is an upper perspective view of a representative cap having the second embodiment of the instant invention mounted thereof, the flashlight being shown in phantom.
Figure 10:
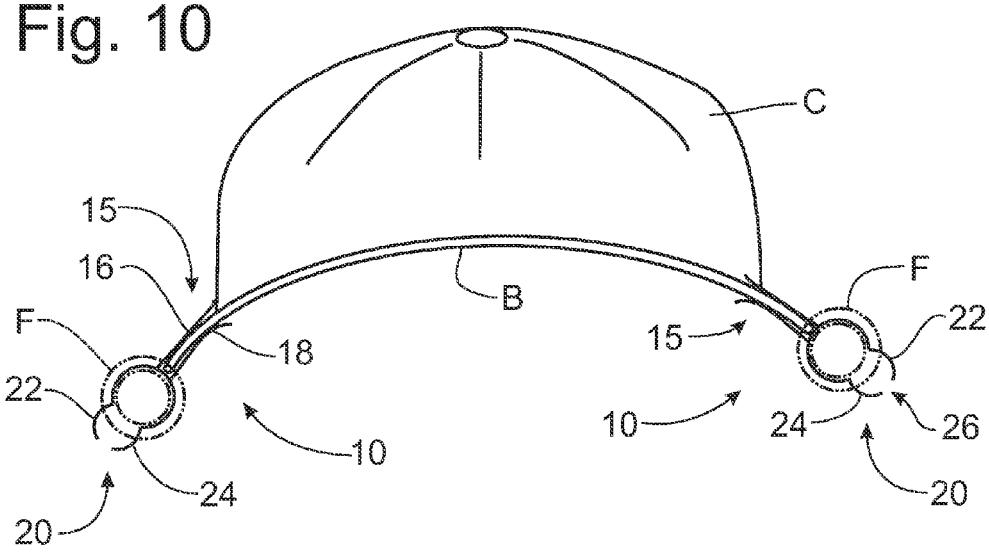
FIG. 10 is a front elevational view of a representative cap having a mounting clip incorporating the principles of the instant invention mounted on both sides of bill of the cap.

The clip portion 15 includes an upper member 16 and a lower member 18, which is preferably formed with a curved tip 19 to facilitate engagement of the clip portion with the bill B of a cap, as is depicted in FIGS. 9 and 10. The plastic clip portion 15 is preferably covered with a rubber-like or soft plastic coating to enhance the gripping of the clip portion 15 onto the bill B. The upper and lower members 16, 18 are memory-retentive in that when flexed out of their home position, as depicted in dashed lines in FIG. 2, they have an inherent spring bias to return to their home position. This spring bias causes the clip portion 15 to grip the bill B of the cap tightly. In an embodiment of the clip portion 15 that is not memory retentive, a spring mechanism (not shown) placed into engagement between the upper and lower members 16, 18 to urge the members 16, 18 toward one another, may be necessary to provide sufficient grip strength for the clip portion 15.

The flashlight mounting portion 20 is also preferably formed from a memory retentive polymeric material so that the flashlight mounting portion 20 will firmly grasp the barrel of a flashlight F (as seen in FIG. 9) to prevent the flashlight from moving relative to the mounting portion 20. To this end, the flashlight mounting portion 20 may also be coated with a rubber-like or soft plastic material to increase friction between the flashlight barrel and the mounting portion 20.

The flashlight mounting portion 20 includes an upper portion 22 and a corresponding lower portion 24, both of which are formed with arcuate portions that when taken together form a generally circular barrel grasping portion 25 in at least two different diameters corresponding to current commercially available mini-flashlight barrel diameters. The upper and lower portions are able to flex outwardly, as is depicted in FIG. 2, to permit the opening 26 at the distal end of the flashlight mounting portion 20 to pass over either flashlight barrel diameter. The memory retentive upper and lower portions 22, 24 will then return to the home position, shown in solid lines in FIG. 2, to firmly grasp the barrel of the flashlight F and retain the flashlight F in engagement with the mounting clip 10.

One of ordinary skill in the art will note that the size of the clip portion 15 in the first embodiment of the mounting clip 10 is substantially the same width as the flashlight mounting portion 20. This width, being the transverse dimension shown in FIGS. 3 and 4, is preferably between about one-half inch and about three inches. The preferred embodiment would have this width dimension at about three-quarters of an inch, which would change the relative appearance of the mounting clip 10 in FIGS. 1, 3 and 4, in that the width (the transverse dimension in FIGS. 3 and 4) would be substantially smaller than the length (the transverse dimension in FIG. 1) as shown in FIGS. 1-4. The relatively wider shape of the mounting clip 10 shown in FIGS. 1-4, is used to better shown the invention.

As seen in FIGS. 5-8, the clip portion 15 is not required to have the same width dimension as the flashlight mounting portion 20. In this second embodiment of the invention, the relative widths of these two main components 15, 20 of the mounting clip 10 are in the range of about three-quarters of an inch for the clip portion 15 and about two inches for the flashlight mounting portion 20. Other than the relative width dimensions, these main components 15, 20 are formed as described above with respect to the first embodiment shown in FIGS. 1-4, and operate the same as the first embodiment. The larger width for the flashlight mounting portion 20 is believed to provide enhanced engagement between the upper and lower portions 22, 24 and the barrel of the flashlight F. Thus, the stability of the flashlight F in the mounting clip 10 will be satisfactory while the narrower width of the clip portion 15 will adequately grasp the bill B of the cap.

A representative cap C having a bill B on the front of the cap C is shown in FIGS. 9 and 10. In operation, the mounting clip 10 is positioned on the side part of the bill B so that the bill B slides between the upper and lower members 16, 18, spreading the upper and lower members 16, 18 apart so that the spring bias of the memory retentive material firmly grasps the top and bottom surfaces of the bill B. Prior to placing the mounting clip 10 on the bill B, the flashlight F is preferably placed into the flashlight mounting portion 20 by spreading the upper and lower portions 22, 24 apart to slide the barrel of the flashlight F through the opening 26 to allow the barrel to be positioned within the appropriate diameter barrel grasping portion 25. Once placed within the barrel grasping portion 25, the upper and lower portions 22, 24 will spring back together to firmly grip the barrel of the flashlight F.

As shown in FIG. 9, the mounting clip 10 can be placed on a side of the cap C to cast a beam of light from the flashlight forwardly of the wearer of the cap C. A pair of mounting clips 10 could be placed with one on either side of the bill B, as is depicted in FIG. 10, to provide balance to the weight of the flashlights F placed on the cap C and to provide twice as much light shining forwardly of the wearer of the cap C. Accordingly, the utilization of the mounting clip 10 to mount a mini-flashlight F on the side of the bill B of the cap C allows the deployment of a flashlight aligned generally with the eyes of the wearer without requiring either of the wearer's hands to be utilized to manipulate the flashlight.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A mounting clip for attaching a flashlight to an article, comprising:

a clip portion including an upper member and an opposing lower member defining a slot therebetween positionable on opposite sides of the article, said upper and lower members being biased toward one another to exert a gripping force on the article;

a flashlight mounting portion formed integrally with said clip portion and including a barrel grasping portion oriented orthogonally to said clip portion in alignment with said slot to mount said flashlight such that said flashlight is oriented perpendicularly to said clip portion, said flashlight mounting portion including an upper portion and a vertically spaced lower portion forming opposing arcuate segments that define said barrel grasping portion, said upper and lower portions being oriented in general alignment with said upper and lower members of said clip portion and being biased toward one another to exert a gripping force on said flashlight when placed between said opposing arcuate segments so as to locate said flashlight in general alignment with the article; and wherein each of the arcuate segments on each of said upper and lower portions have different diameters.

2. The mounting clip of claim 1 wherein said clip portion and said flashlight mounting portion have a width dimension oriented generally parallel to the orientation of said flashlight in said barrel grasping portion, said width dimension of said clip portion being substantially equal to the width dimension of said flashlight mounting portion.

3. The mounting clip of claim 1 wherein said clip portion and said flashlight mounting portion have a width dimension oriented generally parallel to the orientation of said flashlight in said barrel grasping portion, said width dimension of said clip portion being smaller than the width dimension of said flashlight mounting portion.

4. The mounting clip of claim 1 wherein said upper and lower portions are spaced apart at a distal end of said flashlight mounting portion to define an opening into said barrel grasping portions.

5. The mounting clip of claim 4 wherein said upper and lower portions of said flashlight mounting portion can flex away from each other to increase the size of said opening.

6. The mounting clip of claim 5 wherein said upper and lower portions are spring biased toward a home position to exert a gripping force on said flashlight when placed within said barrel grasping portion.

7. A mounting clip for attaching a flashlight to a bill of a cap, comprising:

a clip portion including an upper member and an opposing lower member positionable on opposite sides of said bill, said upper and lower members being biased toward one another to exert a gripping force on said bill; and a flashlight mounting portion having a upper portion and a lower portion formed integrally with said clip portion and including a barrel grasping portion oriented orthogonally to said clip portion to mount said flashlight such that said flashlight is oriented perpendicularly to said clip portion, said barrel grasping portion being formed as a pair of opposing arcuate segments on each of said upper and lower portions, each said opposing arcuate segments being configured with different diameters with respect to the other opposing arcuate segments to receive flashlights having two different diameter barrels.

8. The mounting clip of claim 7 wherein said upper and lower portions are spaced apart at a distal end of said flashlight mounting portion to define an opening into said barrel grasping portion.

9. The mounting clip of claim 8 wherein said upper and lower portions of said flashlight mounting portion can flex away from each other to increase the size of said opening for the passage of a flashlight barrel into said barrel grasping portion, said upper and lower portions being spring biased toward a home position to exert a gripping force on said flashlight when placed within said barrel grasping portion.

10. The mounting clip of claim 9 wherein said clip portion and said flashlight mounting portion have a width dimension oriented generally parallel to the orientation of said flashlight in said barrel grasping portion, said width dimension of said clip portion being substantially equal to the width dimension of said flashlight mounting portion.

11. The mounting clip of claim 9 wherein said clip portion and said flashlight mounting portion have a width dimension oriented generally parallel to the orientation of said flashlight in said barrel grasping portion, said width dimension of said clip portion being smaller than the width dimension of said flashlight mounting portion.

12. A mounting clip for attaching a flashlight to an article, comprising:

a clip portion including an upper member and an opposing lower member positionable on opposite sides of the article, said upper and lower members being biased toward one another to exert a gripping force on the article; and a flashlight mounting portion formed integrally with said clip portion and including:

an upper portion having first and second arcuate segments spaced longitudinally along said upper portion; and a lower portion having first and second arcuate segments opposing the corresponding arcuate segments on said upper portion to define a barrel grasping portion oriented orthogonally to said clip portion to mount said flashlight between a selected pair of opposing corresponding said arcuate segments such that said flashlight is oriented perpendicularly to said clip portion, said upper and lower portions being in general alignment with said upper and lower members of said clip portion so that said flashlight mounting portion will locate said flashlight in general horizontal alignment with said bill of said cap; wherein each of the arcuate segments on each of said upper and lower portions have a different diameter so that said barrel grasping portion is engagable with differently sized flashlight barrels.

13. The mounting clip of claim 12 wherein said upper and lower portions are spaced apart at a distal end of said flashlight mounting portion to define an opening into said barrel grasping portion, said upper and lower portions of said flashlight mounting portion being biased so as to be operable to flex away from each other so as to increase the size of said opening for the passage of a flashlight barrel into said barrel grasping portion.

14. The mounting clip of claim 13 wherein said clip portion and said flashlight mounting portion have a transverse width dimension, said width dimension of said clip portion being substantially equal to the width dimension of said flashlight mounting portion.

15. The mounting clip of claim 13 wherein said clip portion and said flashlight mounting portion have a width dimension oriented generally parallel to the orientation of said flashlight in said barrel grasping portion, said width dimension of said clip portion being smaller than the width dimension of said flashlight mounting portion.

* * * * *